US010197261B1

(12) United States Patent
Nakamura

(10) Patent No.: US 10,197,261 B1
(45) Date of Patent: Feb. 5, 2019

(54) LED ILLUMINATION APPARATUS WITH HEAT SINK HAVING A PORTION OF HEAT FINS EXPOSED TO AXIAL FORCED FLOW FROM A COOLING FAN

(71) Applicant: Shoichi Nakamura, Nagano-ken (JP)

(72) Inventor: Shoichi Nakamura, Nagano-ken (JP)

(73) Assignees: Shoichi Nakamura, Higashichikuma-Gun, Nagano-Ken (JP); ACP JAPAN CO., LTD., Tokyo (JP)

( * ) Notice: Subject to any disclaimer, the term of this patent is extended or adjusted under 35 U.S.C. 154(b) by 0 days.

(21) Appl. No.: 15/802,748

(22) Filed: Nov. 3, 2017

(51) Int. Cl.

| | |
|---|---|
| ***F21V 29/67*** | (2015.01) |
| ***F21V 29/503*** | (2015.01) |
| ***F21V 29/74*** | (2015.01) |
| ***F21K 9/233*** | (2016.01) |
| ***F21V 29/507*** | (2015.01) |
| *F21Y 115/10* | (2016.01) |
| *F21V 17/12* | (2006.01) |
| *F21V 29/83* | (2015.01) |

(52) U.S. Cl.
CPC ..... *F21V 29/503* (2015.01); *F21K 9/233* (2016.08); *F21V 29/507* (2015.01); *F21V 29/677* (2015.01); *F21V 29/74* (2015.01); *F21V 17/12* (2013.01); *F21V 29/83* (2015.01); *F21Y 2115/10* (2016.08)

(58) Field of Classification Search
None
See application file for complete search history.

(56) References Cited

U.S. PATENT DOCUMENTS 8,115,395 B2 * 2/2012 Horng ..... F21V 29/02 315/117

FOREIGN PATENT DOCUMENTS

| | | |
|---|---|---|
| JP | 2007-042755 A | 2/2007 |
| JP | 2011-165351 A | 8/2011 |

* cited by examiner

*Primary Examiner* — Elmito Breval
(74) *Attorney, Agent, or Firm* — Manabu Kanesaka

(57) ABSTRACT

An LED illumination apparatus includes an LED device; a base having a concavity for receiving the LED device; a heat sink including a plate coupled to the base and a plurality of fins extending from a surface of the plate opposite the base, the fins extending laterally beyond sides of the plate; a cooling fan for forcing air over the fins; and a casing housing the LED substrate, the base, the heat sink, and the cooling fan.

3 Claims, 9 Drawing Sheets

LED ILLUMINATION APPARATUS WITH HEAT SINK HAVING A PORTION OF HEAT FINS EXPOSED TO AXIAL FORCED FLOW FROM A COOLING FAN

BACKGROUND OF THE INVENTION

Field of the Invention

The present invention relates to an LED illumination apparatus provided with a heat sink and a cooling fan.

Description of the Related Art

Various types of illumination apparatuses using an LED element with high efficiency and long life have been put into practical use. However, in the illumination apparatus using the LED element, when the temperature inside the main body case of the illumination apparatus rises due to heat generated from the LED element, light emitting efficiency of the LED is deteriorated to reduce light output of the illumination apparatus, and the lifetime of the LED element is shortened.

In order to cope with these problems, the LED apparatuses generally adopt a configuration in which cooling is performed with a plurality of fins provided on the back side of a substrate mounting the LED element thereon (see, for example, Patent Document 1). Further, there are known LED illumination apparatuses that perform cooling using a fan device (see, for example, Patent Document 2).

PRIOR ART DOCUMENT

Patent Document

[Patent Document 1] Japanese Patent Application Publication No. 2007-042755

[Patent Document 2] Japanese Patent Application Publication No. 2011-165351

Among such various illumination apparatuses using the LED element, there are known downsized LED illumination apparatuses that are used by being attached to a wearing article such as glasses or a headband or clothing. When such an illumination apparatus is attached to a person's head, the face direction coincides with the light irradiation direction, so that illumination along the visual line direction is possible. Thus, illumination apparatuses of such a type are optimal for use in locally illuminating the hands of a worker, etc.

However, in the downsized LED illumination apparatus, a heat radiation amount is small since the entire surface area is small. Thus, even though the plurality of fins formed on the back side of the substrate mounted with the LED element are fitted to a groove part formed in the casing of the illumination apparatus so as to increase a contact area between the substrate and the casing as in the LED illumination apparatus of Patent Document 1, high heat radiation effect cannot be obtained since the sizes of the substrate and casing are limited.

Further, when the fan is used to form an air flow path in an illumination part to introduce air from outside to the LED element, as in the LED illumination apparatus of Patent Document 2, airtightness in the illumination part is degraded, which may result in reduction in illuminance due to dust and moisture entering the casing.

SUMMARY OF THE INVENTION

The present invention has been made in view of the above points, and the object thereof is to provide an LED illumination apparatus capable of efficiently cooling the LED element using a cooling fan while maintaining airtightness inside the illumination part.

To solve the above problems, an LED illumination apparatus according to the present invention includes: an LED substrate on which an LED package is mounted; a base having a concave part for housing the LED substrate; a heat sink; a cooling fan; and a casing housing the LED substrate, base, heat sink, and cooling fan. The heat sink is constituted of a rectangular flat plate which is thermally connected to a surface of the base opposite to the surface in which the concave part is formed and a plurality of rib-shaped first heat radiation fins which are disposed on a heat radiation surface of the flat plate opposite to the surface thereof thermally connected to the base such that both ends of each thereof protrude outward from a pair of opposing sides of the flat plate. The base is formed into a shape from which the part of each first heat radiation fin that protrudes from the flat plate is exposed in a state where the first heat radiation fins are disposed on the heat radiation surface. The cooling fan takes in air from a surface of the casing on the side that the LED package emits light and forms an air passage along which the taken-in air passes through the both ends of each first heat radiation fin and goes out of the casing.

In this case, by making the rotation diameter of the cooling fan substantially equal to the dimension of the first heat radiation fins in its linear direction, air taken in by the heat radiation fan hits the heat sink in the axial direction, thereby achieving efficient heat exchange.

Further, a plurality of second heat radiation fins are formed so as to protrude outward by substantially the same dimension as that of the first heat radiation fin from the end portion of a side of the flat plate other than the pair of opposing sides thereof from which the both ends of each heat radiation fin protrude, and the base is formed into a shape from which the second heat radiation fins protrude. With this configuration, heat radiation efficiency is enhanced.

Further, the LED substrate has a through hole so as to allow air in the illumination part to directly contact the base. With this configuration, heat conductivity to the base is enhanced.

According to the LED illumination apparatus, heat is absorbed by the heat sink which is brought into surface contact with the LED substrate at the flat plate. The absorbed heat is diffused to the end portions of each heat radiation fin and then heat-exchanged with air taken in by the cooling fan to be efficiently discharged.

DESCRIPTION OF THE PREFERRED EMBODIMENTS

An embodiment of the present invention will be described below with reference to the accompanying drawings.

Figure 1:
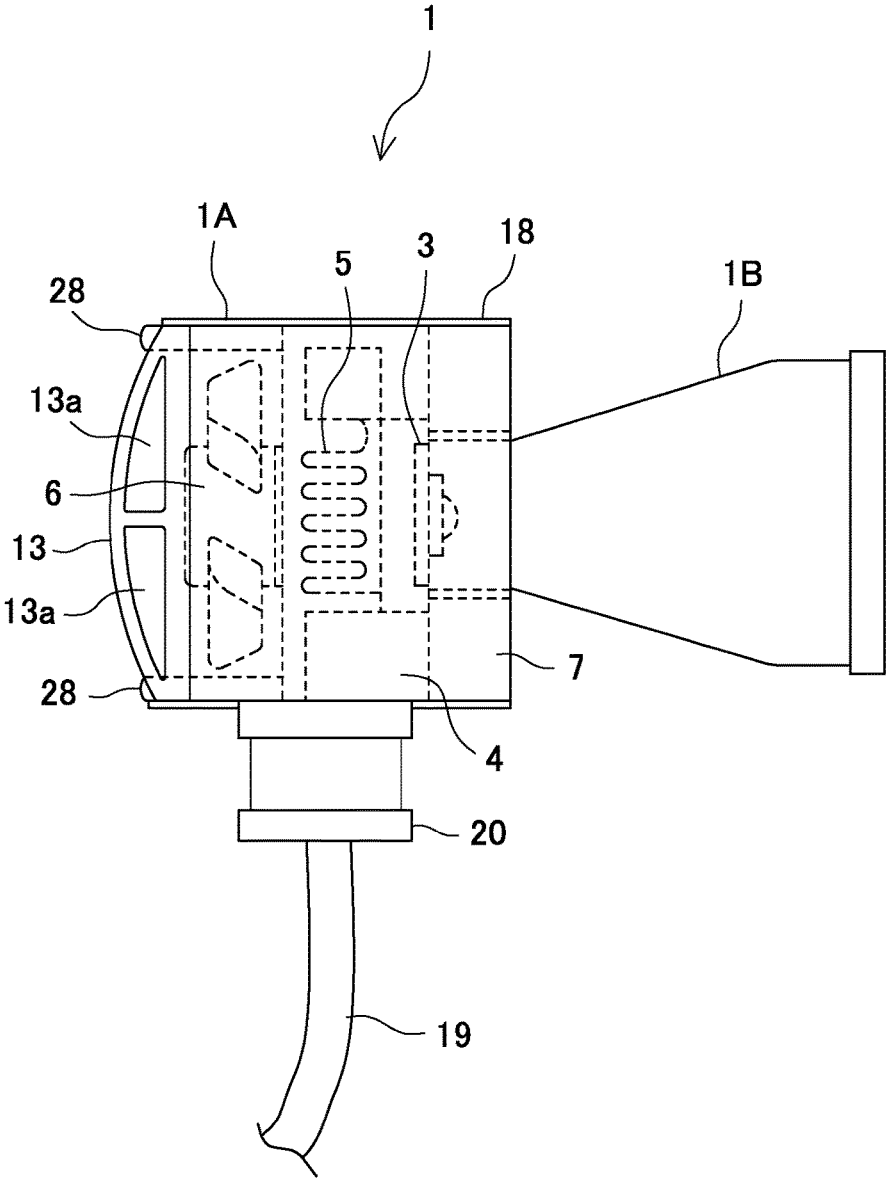
FIG. 1 is a side view of an LED illumination apparatus according to an embodiment of the present invention.

FIG. 1 is a side view illustrating the outer appearance of an LED illumination apparatus 1 according to the present invention. The LED illumination apparatus 1 is constituted of a main body part 1A and an illumination part 1B that houses an LED package 8 in a truncated cone-shaped cylinder.

The main body part 1A includes an LED substrate 3, a base 4, a heat sink 5, a cooling fan 6, and an installation member 7 for mounting the illumination part 1B inside a rectangular prism-shaped casing 18. A rear cover 13 having an air outlet 13*a* is formed in the opening surface of the casing 18 on the cooling fan 6 side.

Figure 2A:
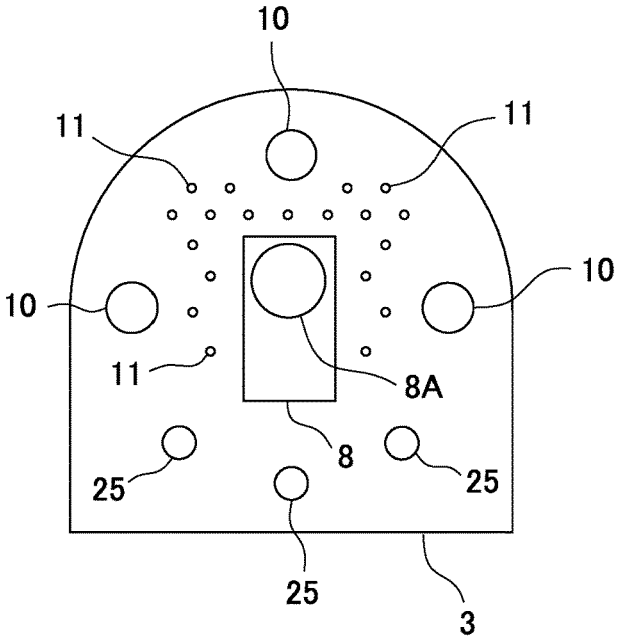
FIG. 2A is a plan view illustrating the configuration of the front surface of an LED substrate in the LED illumination apparatus according to the present embodiment.
Figure 2B:
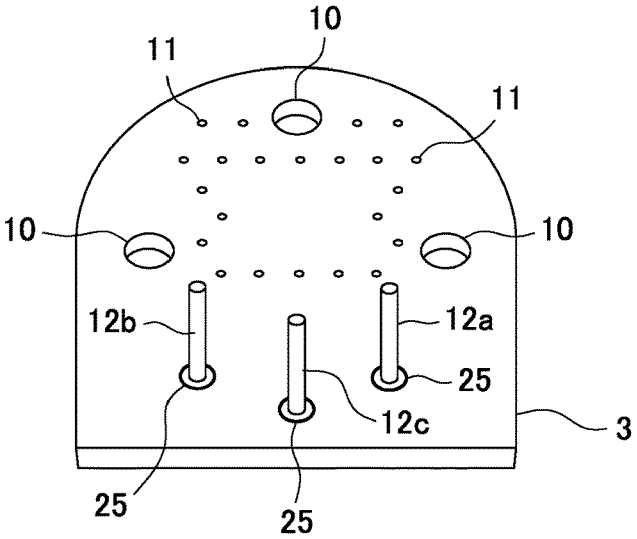
FIG. 2B is a perspective view illustrating the configuration of the rear surface of the LED substrate in the LED illumination apparatus according to the present embodiment.

The LED substrate 3 is formed of resin having high heat conductivity or metal (including its alloy). FIG. 2A is a plan view illustrating the surface (hereinafter, referred to as "front surface") of the LED substrate 3 on the illumination part 1B side, and FIG. 2B is a perspective view illustrating the surface (hereinafter, referred to as "rear surface") opposite to the front surface. A module having an LED package 8 including an LED chip 8A and a driver is mounted with an adhesive on the front surface of the LED substrate 3. The adhesive is a silicone-based adhesive exhibiting superior heat conductivity.

A screw hole 10 for mounting, a plurality of small-diameter through holes 11, and a lead wire introducing port 25 are drilled in the LED substrate 3. Feed wires 12*a* and 12*b* connected to the respective LED chip and driver incorporated in the LED package 8 and a common ground wire 12*c* are made to pass through the three lead wire introducing ports 25.

Figure 3:
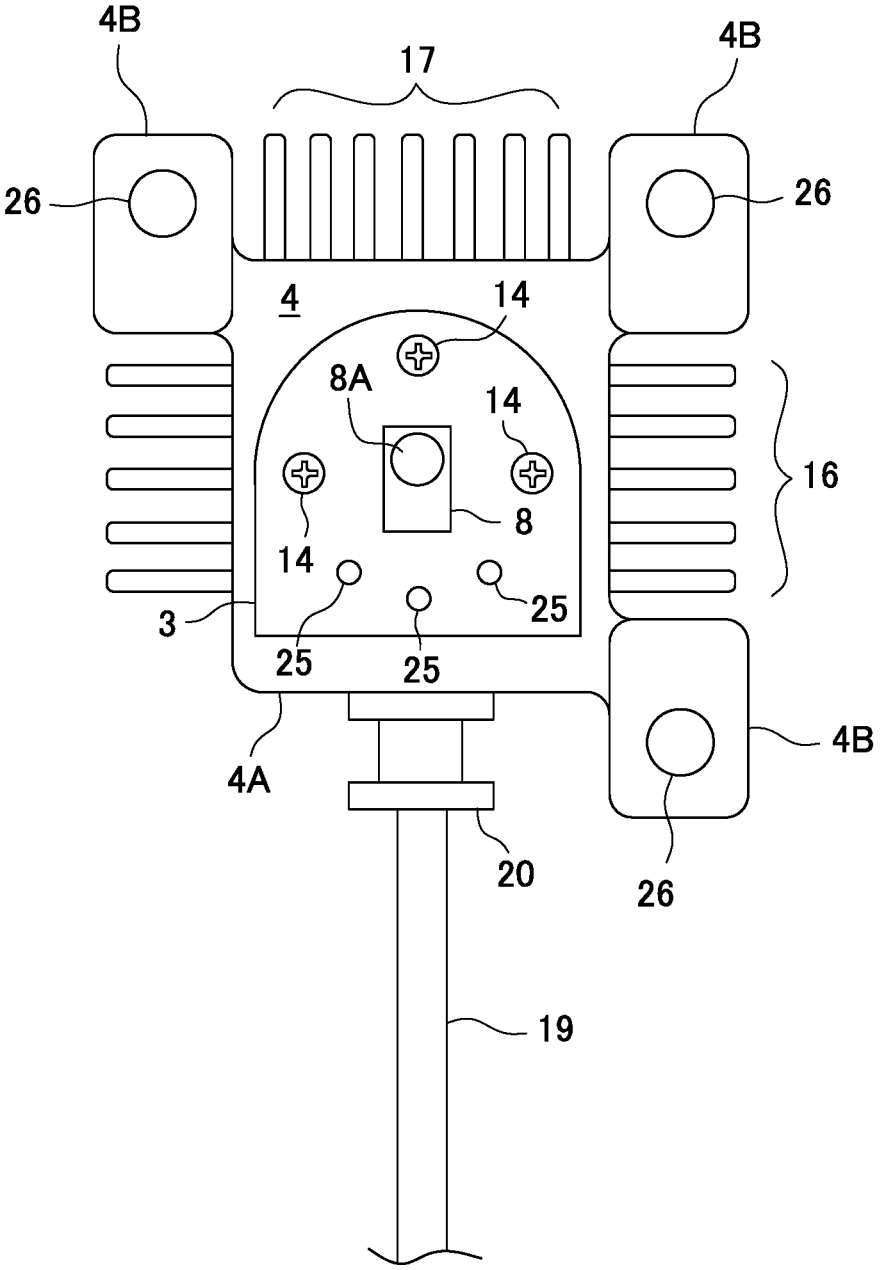
FIG. 3 is a plan view illustrating the front surface of a base in a state where the LED substrate and a heat sink are assembled to the base.

The base 4 holds the LED substrate 3 and is mounted with the heat sink 5. In this case, the base 4 may not necessarily be formed of resin having high heat conductivity. FIG. 3 is a plan view illustrating the front surface of the base 4 in a state where the LED substrate 3 and heat sink 5 are assembled to the base 4. The base 4 is constituted of a center part 4A and a mounting part 4B having a hole 26 through which a screw for assembly penetrates. The mounting part 4B is disposed on the line extending from a corner of the center part 4A in the diagonal direction so as to face the installation member 7 for mounting the illumination part 1B and protrudes in the axial direction from the rear surface.

A receiving port 20 for a harness 19 inserted from outside is mounted to one side of the center part 4A. Wires in the harness 19 include a feeding wire connected to the LED package 8 and feed and ground wires connected to a cooling fan 6. Although not illustrated, a lead wire drawn out from the harness 19 is connected to the cooling fan 6 and the LED package 8.

The front surface of the base 4 serves as a contact surface with the LED substrate 3 and has a concave part 29 (see FIG. 7) in which the LED substrate 3 is housed. The LED substrate 3 is tightly fitted to the bottom surface of the concave part 29 with a heat radiation grease interposed therebetween and fixed to the base 4 by screws 14 penetrating through the screw holes 10.

Figure 4:
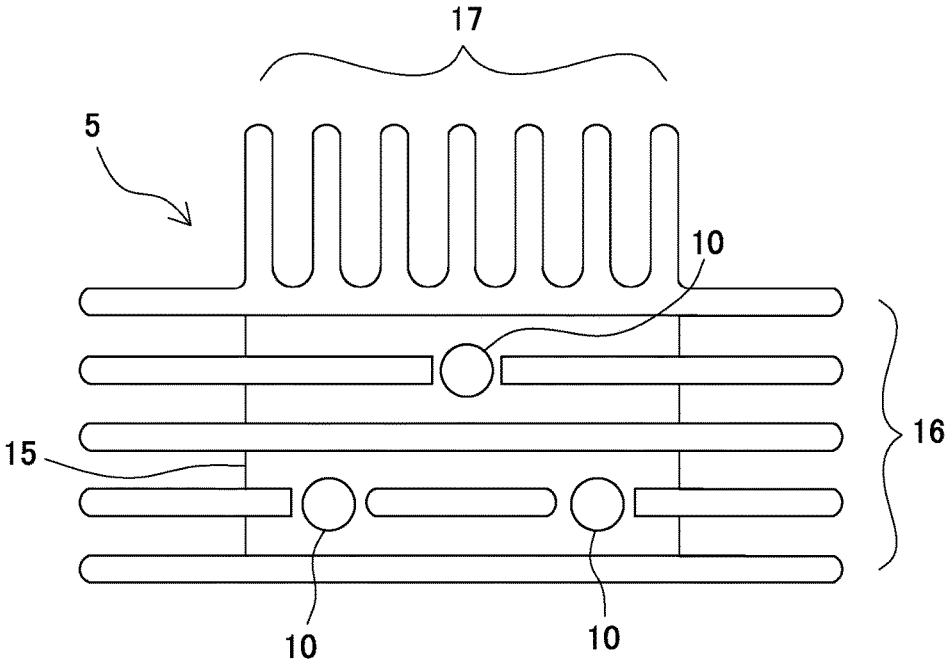
FIG. 4 is a plan view illustrating the heat radiation surface of the heat sink.

The heat sink 5 is formed of aluminum having high heat conductivity or its alloy. As illustrated in FIG. 4, the heat sink 5 is constituted of a flat plate 15, a plurality of rib-shaped heat radiation fins 16, and a plurality of heat radiation fins 17. The rib-shaped heat radiation fins 16 are formed so as to extend over a pair of opposing sides of the flat plate 15 and such that both ends of each thereof protrude outward. Some of the heat radiation fins 16 are cut out at the portion where the screw 14 penetrates through the screw hole 10 formed in the base 4 and heat sink 5. The plurality of heat radiation fins 17 are formed so as to protrude outward from the end portion of a side of the flat plate 15 other than the pair of opposing sides.

The outward protruding part of each heat radiation fin 17 has substantially the same dimension as that of the part of each heat radiation fin 16 that protrudes from the side of the flat plate 15 perpendicular thereto. The surface part of each of the plate-like heat radiation fins 16 and 17 extends perpendicular to the surface of the flat plate 15.

Figure 5:
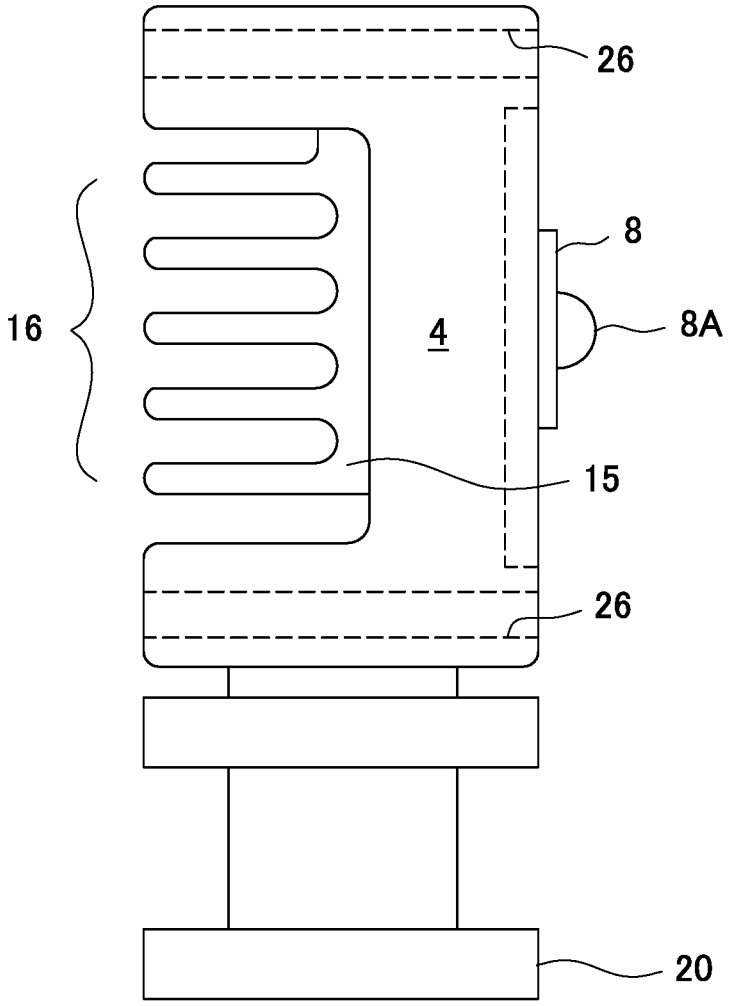
FIG. 5 is a side view of the base in a state where the LED substrate and heat sink are assembled to the base.

FIG. 5 is a side view illustrating a state where the heat sink 5 is assembled to the base 4. In this state, both end portions of each heat radiation fin 16 of the heat sink 5 that protrude from the flat plate 15 and each heat radiation fin 17 are exposed from the base 4 as well.

Figure 6:
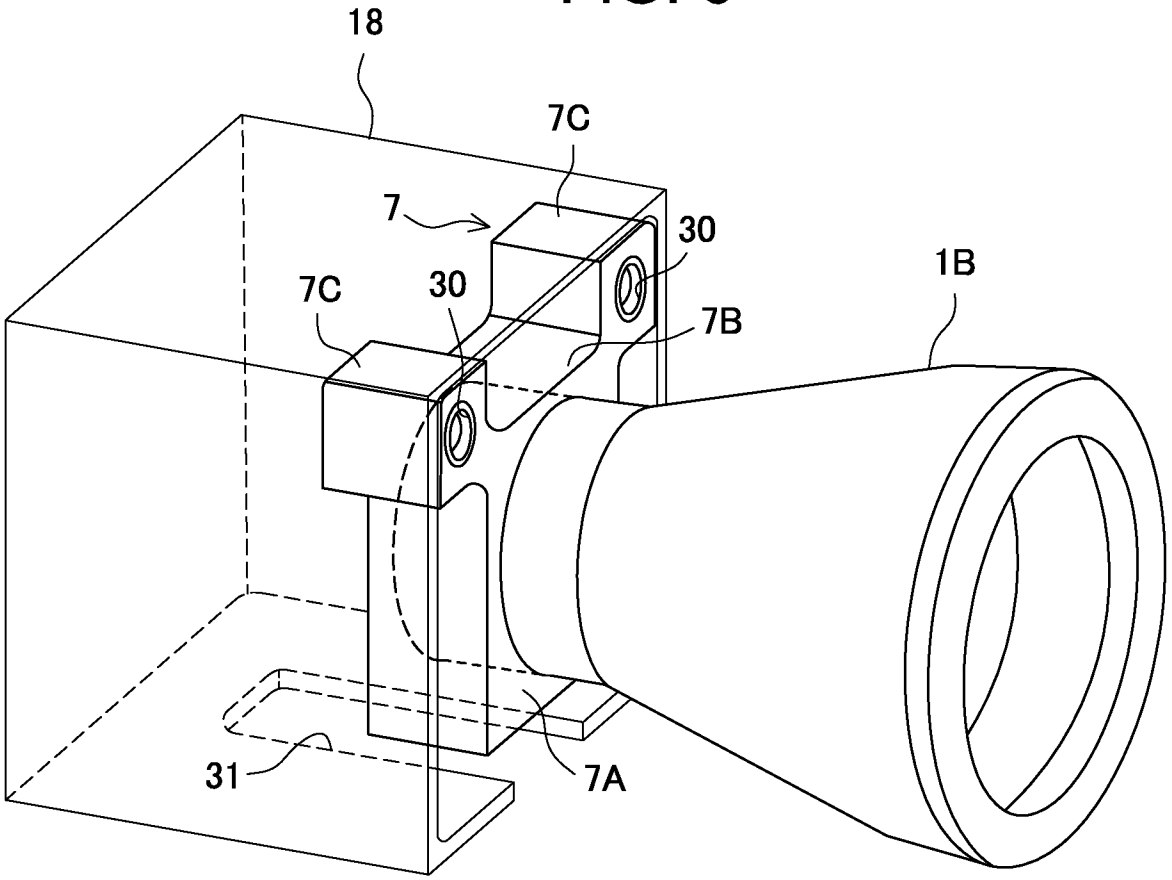
FIG. 6 is an explanatory view in a state where an installation member mounted with an illumination part is set in a casing.

As illustrated in FIG. 6, the center portion of the installation member 7 serves as a mounting part 7A to which the illumination part 1B is fitted. Around the mounting part 7A, an air inlet 7B is formed by cutting out the parts of the mounting part 7A that are opposed to the both ends of each heat radiation fin 16 and each heat radiation fin 17 of the heat sink 5 that protrude from the flat plate 15. A screw hole 30 extending along the axial direction is formed in three corner parts 7C of the mounting part 7A that contact the corners of the casing 18. The screw hole 30 communicates with the through hole 26 of the mounting part 4B of the base 4.

Figure 7:
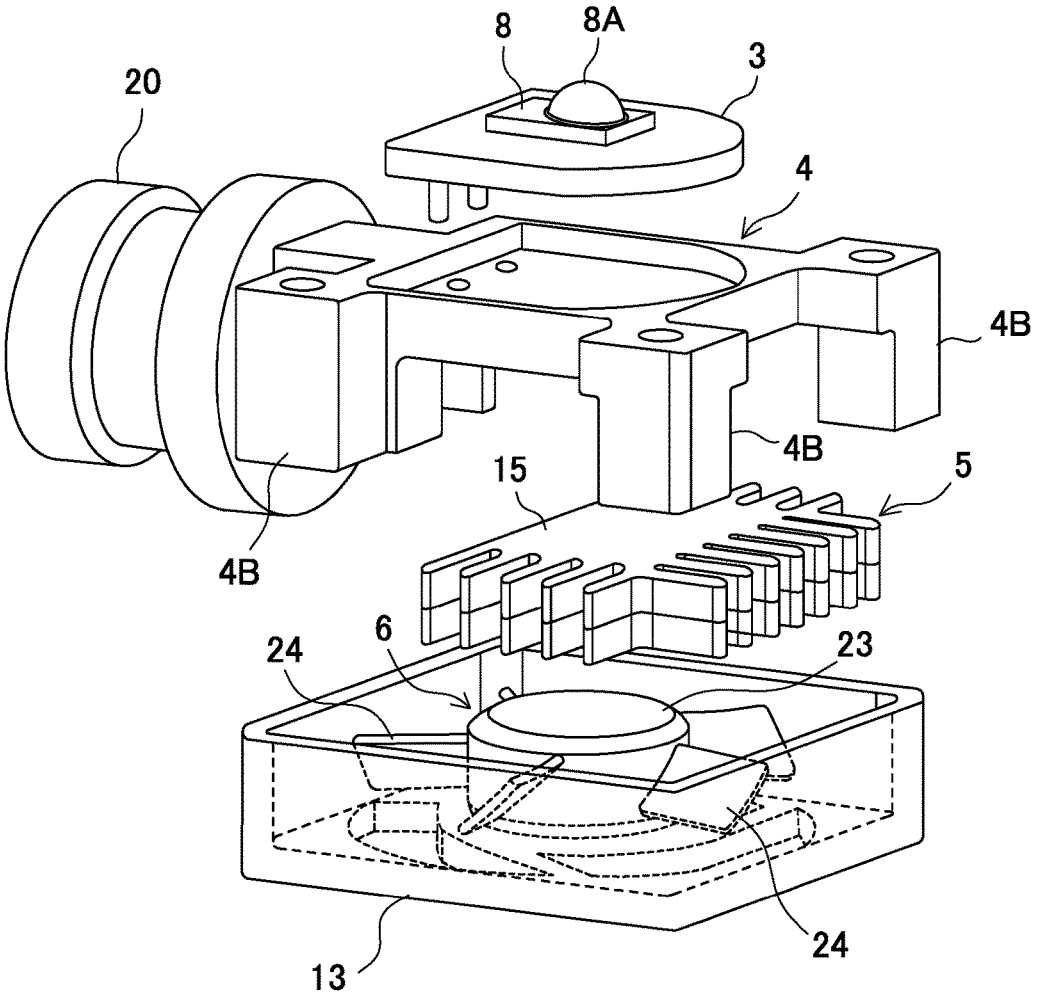
FIG. 7 is a perspective view of the LED substrate, base, heat sink, a cooling fan, and a rear cover which are assembled to form the LED illumination apparatus according to the embodiment of the present invention.

As illustrated in FIG. 7, the cooling fan 6 is an axial flow type fan provided with an impeller 24 driven by a brushless DC fan motor 23, and configured to take in air in the axial direction of the casing 18 from outside through the air inlet 7B of the rear cover 13 by rotation of the impeller 24 and to blow out the air toward the heat sink 5. The rotation diameter of the cooling fan 6 is made substantially equal to the dimension of the heat radiation fins 16 in its linear direction to thereby completely cover the heat sink 5.

Figure 8:
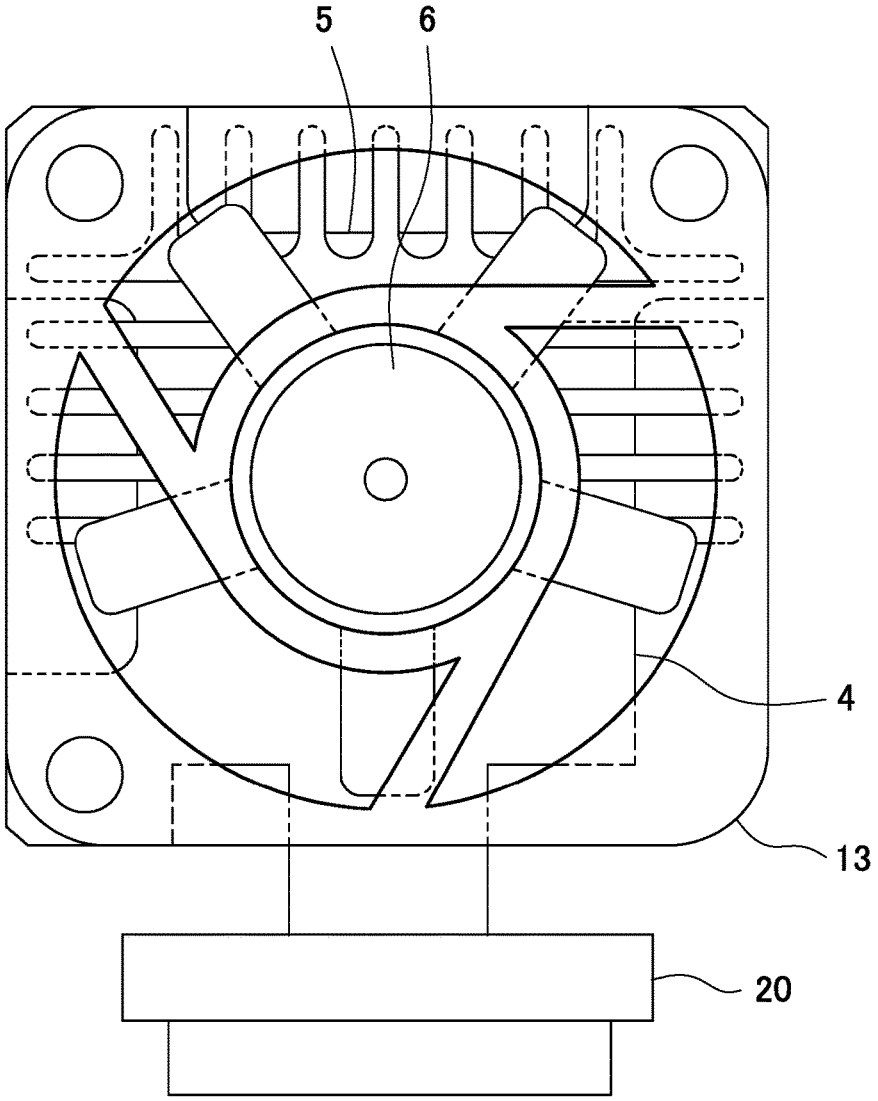
FIG. 8 is a plan view of the base, heat sink, cooling fan, and rear cover as viewed from the outside of the rear cover.

As illustrated in FIG. 8, the cooling fan 6 is supported and fixed in the casing 18 by the rear cover 13. In this case, the installation member 7 mounted with the illumination part 1B, the base 4 assembled with the LED substrate 3 and heat sink 5, and the cooling fan 6 are overlapped in the axial direction and disposed inside the casing 18, and the rear cover 13 is put on the suction side of the cooling fan 6, followed by fastening by means of screws 28, whereby the LED illumination apparatus 1 is completed. A slit 31 is formed in the casing 18. At assembly of the LED illumination apparatus 1, the slit 31 serves as a recess part for the receiving port 20 to be inserted into the casing 18 when the base 4 is housed therein.

Figure 9:
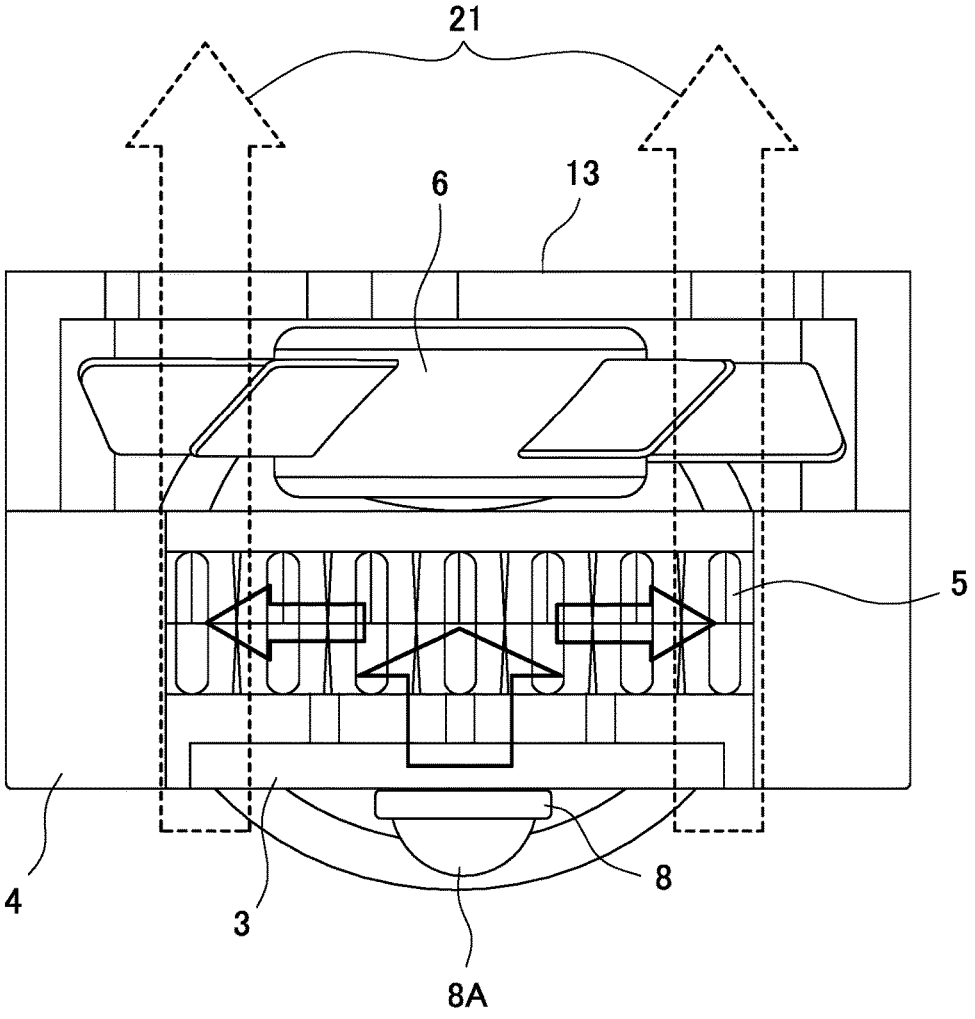
FIG. 9 is a view for explaining a state where heat from the LED substrate is absorbed by the heat sink and radiated by air taken in by the cooling fan.

The heat radiation effect of the LED illumination apparatus 1 having the above configuration will be described. As illustrated in FIG. 9, heat generated in the LED package 8 at the time of lighting is transmitted to the LED substrate 3 in the continuous-line arrow direction. The LED substrate 3 is housed in the concave part 29 formed in the front surface of the base 4 so as to be tightly fitted thereto, and the heat transmitted to the LED substrate 3 is discharged to the base 4 through the heat radiation grease. At this time, the screws 14 for fixing the LED substrate 3 to the base 4 also contribute to heat conduction.

The LED substrate 3 is thus housed in the concave part 29, so that the base 4 effectively absorbs the heat from the LED substrate 3, thus making it possible to reduce a heat radiation amount from the LED substrate 3 to the illumination part 1B. Further, air in the illumination part 1B directly exchanges heat with the base 4 through the through holes 11 formed in the LED substrate 3, which also contributes to suppression of temperature rise in the illumination part 1B.

The heat transmitted to the base 4 is transmitted to the flat plate 15 of the heat sink 5 from the center part 4A of the base 4 and is then diffused to the heat radiation fins 16 and 17. In the heat radiation fins 16 and 17, the heat is conducted to their outward protruding parts. The cooling fan 6 is driven by the motor 23 to take in air in the axial direction from the air inlet 7B and forms an air passage 21 denoted by the dashed-line arrows along which the taken-in air is discharged from the air outlet 13*a*. Thus, in the heat radiation fins 16 and 17, the heat radially diffused outward is cooled by the air taken in by the cooling fan 6. Since the both end portions of each heat radiation fin 16 and each heat radiation fin 17 are exposed from the sides of the base 4 protruding outward from three sides of the flat plate 15, the air taken in by the cooling fan 6 passes between the surfaces of the heat radiation fins to be discharged without being blocked.

The cooling fan 6 forms the air passage 21 as described above and, thereby, the heat conducted from the LED substrate 3 to the base 4 is effectively heat-exchanged with the air taken in through the heat sink 5 to be radiated outside through the air outlet 13*a*.

In this case, an air passage reverse to the above-described air passage of the embodiment, along which the air flow formed by the cooling fan 6 is introduced from the air outlet 13*a* and discharged from the air inlet 7B is possible; however, in the case of the air passage of the embodiment, cooled air is introduced while being heat-exchanged with the side surface of the illumination part 1B, thus effectively cooling the illumination part 1B, and heat radiation efficiency can be increased by substantially 20%.

Although not illustrated, when a plurality of slits are formed in the side surfaces of the casing 18 that constitute the wind tunnel of the air from the cooling fan 6, the air is discharged from the plurality of slits as well as the air outlet 13*a*. Thus, the air flow rate is increased to thereby further improve heat radiation efficiency.

In the above embodiment, the receiving port 20 for the harness 19 is provided in one side of the base 4, so that the heat radiation fin (heat radiation fins 16, 17) is provided in only three sides of the flat plate 15; however, the heat radiation fin can be provided corresponding to the four sides of the base 4 depending on the layout of the receiving port 20.

What is claimed is:

1. An LED illumination apparatus comprising:

an LED substrate;

an LED package mounted on the LED substrate;

a base having a first surface, a second surface opposite the first surface, and a concave part formed on the first surface for receiving the LED substrate;

a heat sink including a rectangular flat plate having a main surface thermally connected to the second surface of the base, and a heat radiation surface opposite the main surface, and a plurality of first heat radiation fins having a rib-shape and protruding from the heat radiation surface of the flat plate, the first heat radiation fins extending from a periphery of the flat plate at two opposing sides;

a cooling fan; and a casing housing the LED substrate, the base, the heat sink, and the cooling fan, wherein the base is shaped such that a part of each first heat radiation fin extending from the periphery of the flat plate is exposed from the first surface of the base, the cooling fan takes in air from a side of the casing that the LED package emits light and through the first heat radiation fins, and the LED substrate has a through hole so as to allow air in an illumination part to contact the base.

2. The LED illumination apparatus according to claim 1, wherein a diameter of the cooling fan is substantially equal to a length of the first heat radiation fins in a traverse direction.

3. The LED illumination apparatus according to claim 1, wherein the heat sink further includes a plurality of second heat radiation fins protruding from the heat radiation surface of the flat plate by substantially a same size as those of the first heat radiation fins and from the periphery of the flat plate at a side other than the two opposing sides thereof, and the base is further shaped such that the second heat radiation fins are exposed from the first surface of the base.

* * * * *